US012036596B2

(12) United States Patent
Sumikawa

(10) Patent No.: US 12,036,596 B2
(45) Date of Patent: Jul. 16, 2024

(54) PRESS FORMING METHOD

(71) Applicant: JFE Steel Corporation, Tokyo (JP)

(72) Inventor: Satoshi Sumikawa, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 561 days.

(21) Appl. No.: 17/299,077

(22) PCT Filed: Aug. 5, 2019

(86) PCT No.: PCT/JP2019/030639
§ 371 (c)(1),
(2) Date: Jun. 2, 2021

(87) PCT Pub. No.: WO2020/121591
PCT Pub. Date: Jun. 18, 2020

(65) Prior Publication Data

US 2022/0055085 A1 Feb. 24, 2022

(30) Foreign Application Priority Data

Dec. 12, 2018 (JP) ..... 2018-232199

(51) Int. Cl.
*B21D 22/26* (2006.01)
*B21D 22/22* (2006.01)
(Continued)

(52) U.S. Cl.
CPC ..... *B21D 22/26* (2013.01); *B21D 22/22* (2013.01); *B21D 24/04* (2013.01); *B21D 53/88* (2013.01)

(58) Field of Classification Search
CPC ..... B21D 22/22; B21D 22/26; B21D 24/04; B21D 53/88
See application file for complete search history.

(56) References Cited

U.S. PATENT DOCUMENTS 5,735,163 A 4/1998 Sato et al.
9,266,162 B2 2/2016 Tanaka et al.
(Continued)

FOREIGN PATENT DOCUMENTS

JP 56117831 A 9/1981
JP 5897430 A 6/1983
(Continued)

OTHER PUBLICATIONS

International Search Report and Written Opinion for International Application No. PCT/JP2019/030639, dated Oct. 29, 2019, 6 pages.
(Continued)

*Primary Examiner* — Teresa M Ekiert
(74) *Attorney, Agent, or Firm* — Buchanan Ingersoll & Rooney PC

(57) ABSTRACT

A method includes: forming either one or both of convex and concave bead portions at surface portions corresponding to sites of a side wall portion on both sides of a convex curve site and to sites of a side wall portion on both sides of a concave curve site; and squashing the bead portions, wherein the bead portions formed on both sides of the convex curve site are tilted such that an end part of the bead portion positioned on the convex curve site side is farther from a baseline and the other end part is closer to the baseline; and the bead portions formed on both sides of the concave curve site are tilted such that an end part of the bead portion positioned on the concave curve site side is closer to the baseline and the other end part is farther from the baseline.

3 Claims, 15 Drawing Sheets

(51) Int. Cl.
*B21D 24/04* (2006.01)
*B21D 53/88* (2006.01)

(56) References Cited

U.S. PATENT DOCUMENTS

| | | | | |
|---|---|---|---|---|
| 2007/0180697 | A1* | 8/2007 | Knaup | B21D 53/88 72/379.2 |
| 2013/0213109 | A1 | 8/2013 | Ogasawara | |
| 2016/0354824 | A1* | 12/2016 | Flehmig | B21D 22/22 |
| 2016/0354825 | A1 | 12/2016 | Shinmiya et al. | |
| 2016/0375477 | A1 | 12/2016 | Tanaka et al. | |
| 2018/0185899 | A1 | 7/2018 | Saito et al. | |
| 2018/0264534 | A1* | 9/2018 | Aso | B21D 22/26 |

FOREIGN PATENT DOCUMENTS

| | | | |
|---|---|---|---|
| JP | 04105721 | A | 4/1992 |
| JP | 08117879 | A | 5/1996 |
| JP | 2010115674 | A | 5/2010 |
| JP | 5168429 | B2 | 3/2013 |
| JP | 5965159 | B2 | 8/2016 |
| WO | 2011145679 | A1 | 11/2011 |
| WO | 2015098871 | A1 | 7/2015 |
| WO | 2015115348 | A | 8/2015 |
| WO | 2017002253 | A1 | 1/2017 |
| WO | 2017006793 | A1 | 1/2017 |

OTHER PUBLICATIONS

Extended European Search Report for European Application No. 19 897 191.3, dated Dec. 17, 2021, 5 pages.

* cited by examiner

PRESS FORMING METHOD

CROSS REFERENCE TO RELATED APPLICATIONS

This is the U.S. National Phase application of PCT/JP2019/030639, filed Aug. 5, 2019, which claims priority to Japanese Patent Application No. 2018-232199, filed Dec. 12, 2018, the disclosures of these applications being incorporated herein by reference in their entireties for all purposes.

FIELD OF THE INVENTION

The present invention relates to a press forming method, and particularly relates to a press forming method of forming a press-formed product including a top portion, a side wall portion and a flange portion, and curved in convex and concave shapes in a height direction at places in a longitudinal direction in side view.

BACKGROUND OF THE INVENTION

Press forming is a method of performing fabrication by pressing a metallic material such as a steel sheet with a die of press forming so that the shape of the die of press forming is transferred. In particular, most automotive parts are produced by press forming. Nowadays, a high-strength steel sheet (high-tension steel sheet) is increasingly often used as an automotive body part to achieve weight reduction of an automotive body. A steel sheet and other metallic materials have such a characteristic that elongation tends to degrade as strength increases. Accordingly, forming defects such as fractures and wrinkles often occur in press forming of a high-tension steel sheet, which is a problem.

Among automotive structural parts, curved parts having steeply curved shapes, such as a rear side member and a floor cross are parts in which fractures and wrinkles are likely to occur and that are difficult to form. Recently, automotive companies and parts companies have been researching application of a high-tension steel sheet to such a curved part to achieve further weight reduction, and how to reduce fractures and wrinkles while performing press forming has been a problem to solve.

Some technologies of press-forming a curved part with reduced fractures and wrinkles have been disclosed so far. For example, Patent Literature 1 discloses a technology in which, in press forming of an L-shaped part curved in top view, forming force that forms a flange and a side wall is used to cause slide on a punch bottom surface of a material, thereby avoiding wrinkles of the punch bottom and fractures of the flange.

Moreover, Patent Literature 2 discloses a technology in which, in press forming of a curved press part having a hat-shaped cross section and curved in a longitudinal direction, a bent portion is provided at an end part of a blank material in a width direction through preliminary forming and the curved press part is formed while the bent portion remains, thereby reducing generation of wrinkles at a flange portion. With this technology, since the bent portion is provided at the end part of the blank material in the width direction through the preliminary forming, stiffness of the end part in the width direction increases and force against contraction force in the longitudinal direction increases, and thus generation of wrinkles at the flange portion can be prevented when contraction force in the longitudinal direction is applied by excess metal due to a curved shape.

In addition, some technologies of press-forming a curved part with beads provided to reduce generation of fractures and wrinkles have been disclosed. Patent Literature 3 discloses a technology in which, in press fabrication through one process into a shape having curvature at an end part of a blank material in plan view and having a flange surface below a side wall surface in side view, convex beads are provided to the side wall surface and concave beads are provided to the flange surface directly below the side wall surface, thereby reducing generation of wrinkles at a formed portion of the blank material.

Patent Literature 4 discloses a technology in which, in press fabrication of a press part including a curve portion curved in plan view and a hat-shaped cross section through one process by bend forming, the press part is manufactured without generating fractures in a flange on an inner periphery side of the curve portion. With this technology, convex beads are formed near (outside) a part formed at the flange on the inner periphery side of the curve portion in a blank to promote material rotation in the bend forming so that the amount of material flowing into the flange portion increases, thereby making it possible to prevent fractures at the flange portion.

Patent Literature 5 discloses a technology in which bead shapes are preliminarily formed at positions on a blank material, which correspond to the vicinity of generation positions of fractures and flange wrinkles, and thereafter a press-formed part including a top portion, a side wall portion, and a flange portion is press-formed from the blank material in which the bead shapes are preliminarily formed. With this technology, when the press-formed part is formed, the bead shapes positioned in the vicinity are squashed and material from the vicinity is supplied near positions at which fractures and flange wrinkles would be generated, thereby making it possible to prevent generation of fractures due to excess extension of the blank material and prevent generation of flange wrinkles due to excess material inflow from the flange portion.

PATENT LITERATURE

Patent Literature 1: Japanese Patent No. 5168429
Patent Literature 2: Japanese Patent No. 5965159
Patent Literature 3: Japanese Patent Laid-open No. 2010-115674
Patent Literature 4: WO2017/006793
Patent Literature 5: WO2015/115348

SUMMARY OF THE INVENTION

However, in the technology disclosed in Patent Literature 1, the material cannot be largely moved in a case in which the punch bottom includes a shape such as a mounted surface or in a case of a closed shape such as a bag shape, and thus a part to which the technology is applicable has been limited. Moreover, in the technology disclosed in Patent Literature 2, a bent shape of the flange portion needs to be formed into a flat shape in a subsequent process, but curl potentially remains. In particular, in a case of an automotive part, a flange often serves as a joining surface for another part and needs to have high surface accuracy, and thus careful application of this forming method has been needed.

Moreover, the technologies disclosed in Patent Literatures 3 and 4, in which press fabrication is performed through one process, each have had the problem that beads provided to prevent wrinkle generation or fractures remain intact. In the technology disclosed in Patent Literature 5, each bead preliminarily formed at a blank material is squashed to reduce deformation in a bead orthogonal direction, but the orientation of the preliminarily formed bead and the direction of material flow when the bead is squashed are not disclosed, and there has been a case in which fractures and wrinkles cannot be effectively prevented in some cases.

Aspects of the present invention are intended to solve the above-described problem and provide a press forming method that can obtain a favorable press-formed product without generating fractures and wrinkles in press forming of a press-formed product including a top portion, a side wall portion and a flange portion, and curved in convex and concave shapes in a height direction at places in a longitudinal direction in side view.

To solve the problem and achieve the object, a press forming method according to aspects of the present invention is a method of forming a press-formed product including: a top portion; a side wall portion continuous with the top portion through top side ridge line portion; a flange portion continuous with the side wall portion; and a convex curve site curved in a convex shape and a concave curve site curved in a concave shape in a height direction along a longitudinal direction in side view, the press forming method includes: a preforming process of forming an intermediate formed product in which either one or both of convex and concave bead portions extending while being tilted relative to a baseline corresponding to the top side ridge line portion, are formed at surface portions corresponding to sites of the side wall portion on both sides of the convex curve site in the longitudinal direction and at surface portions corresponding to sites of the side wall portion on both sides of the concave curve site in the longitudinal direction; and a final forming process of forming the press-formed product by squashing the bead portions in the intermediate formed product and extending a surface portion corresponding to the side wall portion in a bead orthogonal direction orthogonal to a long axis of the bead portion such that pseudo shear deformation occurs to the surface portion corresponding to the side wall portion, wherein at the preforming process: the bead portions formed on both sides of the convex curve site are each tilted such that an end part of the bead portion, along the long axis, positioned on the convex curve site side is farther from the baseline and the other end part of the bead portion positioned on the opposite side is closer to the baseline; and the bead portions formed on both sides of the concave curve site are each tilted such that an end part of the bead portion, along the long axis, positioned on the concave curve site side is closer to the baseline and the other end part of the bead portion positioned on the opposite side is farther from the baseline.

Moreover, in the press forming method according to aspects of the present invention, an angle θ between the long axis of each bead portion formed at the preforming process and the baseline is 5° to 60°.

Moreover, in the press forming method according to aspects of the present invention, the angle θ between the long axis of each bead portion and the baseline satisfies a relation of $\theta \geq 90° - \theta_1$, where $\theta_1$ represents an acute angle between a forming direction of the press-formed product at the final forming process and the top side ridge line portion.

With the press forming method according to aspects of the present invention, since the side wall portion at sites adjacent to the convex and concave curve sites is formed through pseudo shear deformation, it is possible to reduce compressive deformation or tensile deformation at the convex and concave curve sites, and thus it is possible to obtain a favorable press-formed product without generating fractures nor wrinkles in press forming of a press-formed product including a top portion, a side wall portion and a flange portion, and curved in convex and concave shapes in a height direction at places in a longitudinal direction in side view.

DETAILED DESCRIPTION OF EMBODIMENTS OF THE INVENTION

Before describing a press forming method according to an embodiment of the present invention, the following describes a press-formed product as a forming target in accordance with aspects of the present invention, a reason for generation of fractures and wrinkles when the press-formed product is formed, and a background to the present invention. Note that, in drawings, an X axis, a Y axis, and a Z axis represent a longitudinal direction, a width direction, and a height direction of the press-formed product, respectively. Moreover, in the present embodiment, the height direction of the press-formed product is aligned with a forming direction of the press-formed product.

<Press-Formed Product>

Figure 2:
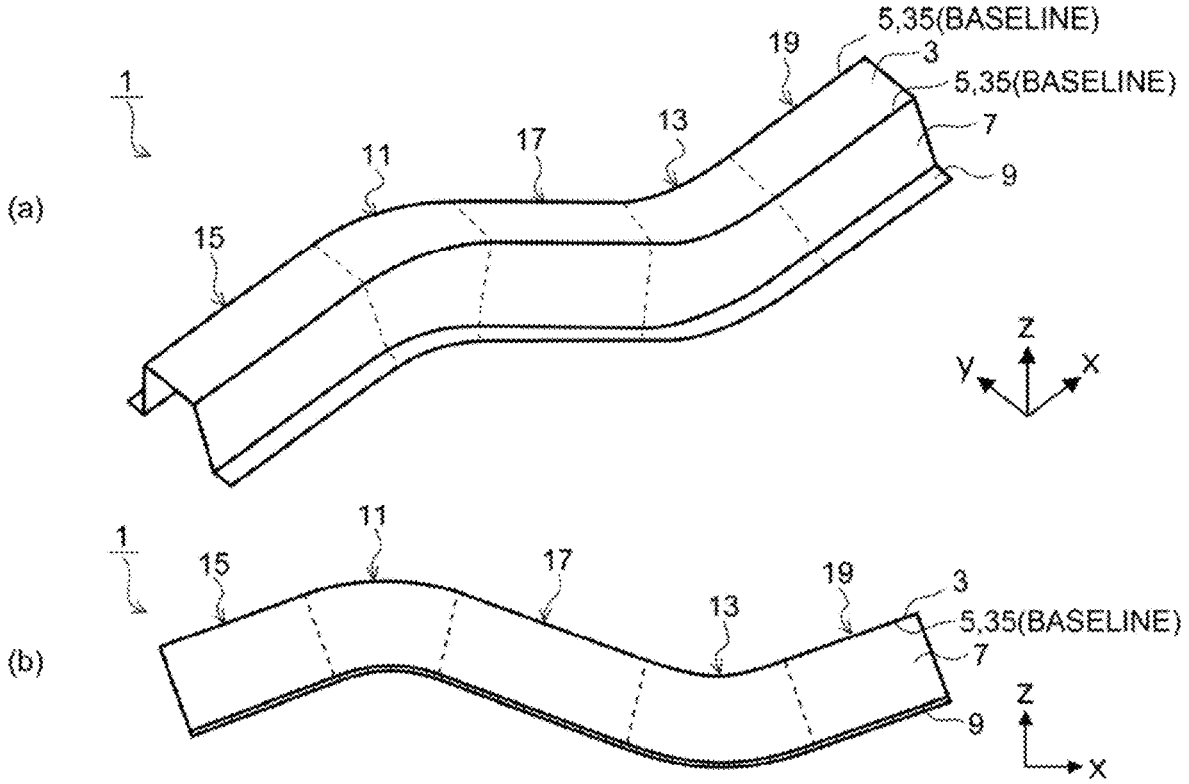
FIG. 2 is a diagram for description of a press-formed product as a forming target in accordance with aspects of the present invention ((a) a perspective view and (b) a side view).

As exemplarily illustrated in FIG. 2, a press-formed product 1 as a target in accordance with aspects of the present invention has a hat-shaped cross section including a top portion 3, a side wall portion 7 continuous with the top portion 3 through a top side ridge line portion 5, and a flange portion 9 continuous with the side wall portion 7, and includes, in the longitudinal direction in side view, a convex curve site 11 curved in a convex shape and a concave curve site 13 curved in a concave shape in the height direction. Moreover, a straight portion 15 and a straight portion 17 are provided on both sides of the convex curve site 11 in the longitudinal direction, and the straight portion 17 and a straight portion 19 are provided on both sides of the concave curve site 13 in the longitudinal direction. Note that, the center of an arc curved in a convex shape in side view in the convex curve site 11 is positioned on the flange portion 9 side, and the center of an arc curved in a concave shape in side view in the concave curve site 13 is positioned on the top portion 3 side.

In this manner, the press-formed product as a forming target in accordance with aspects of the present invention suffices to be curved in the height direction at places in the longitudinal direction, and when a Z direction is defined to be the forming direction, the press-formed product has a shape curved on a ZX plane including a press stroke axis, in other words, curved in side view.

Figure 3:
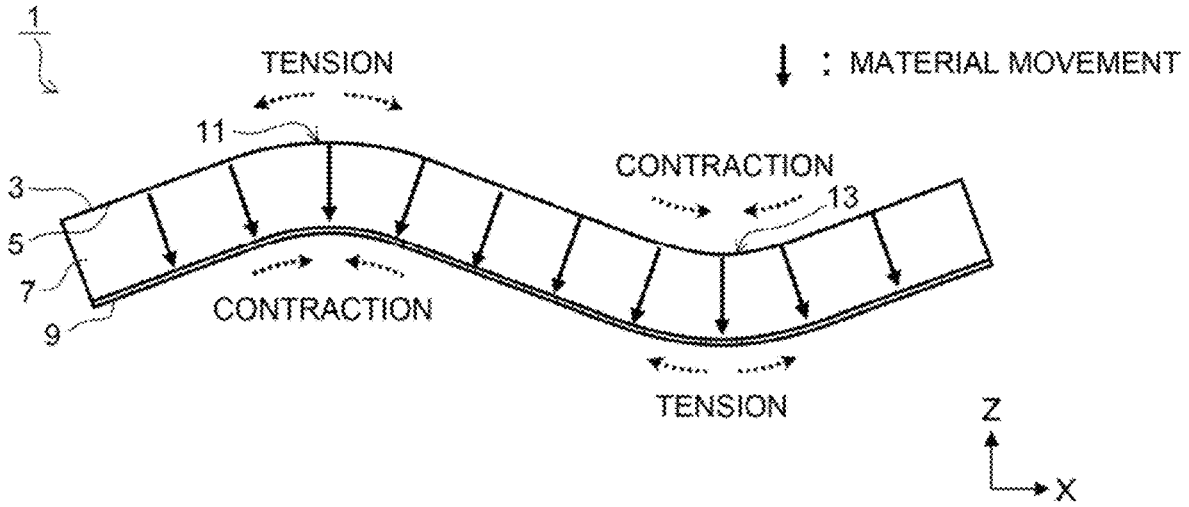
FIG. 3 is a diagram for description of material movement when a press-formed product as a forming target in accordance with aspects of the present invention is formed by a conventional press forming method, and sites at which tensile deformation and compressive deformation occur in the press-formed product.

FIG. 3 illustrates material movement in forming when the press-formed product 1 is viewed from side. When a blank (metal plate) is press-formed, the blank is bent at the top side ridge line portion 5 between the top portion 3 and the side wall portion 7, and material moves in a direction (direction of each arrow in FIG. 3) orthogonal to the top side ridge line portion 5. Then, line length difference in the longitudinal direction occurs between the flange portion 9 and the top portion 3.

Accordingly, at the convex curve site 11, tensile deformation occurs and fractures are likely to be generated in the top portion 3, and compressive deformation occurs and wrinkles are likely to be generated in the flange portion 9. Conversely, at the concave curve site 13, compressive deformation occurs and wrinkles are likely to be generated in the top portion 3, and tensile deformation occurs and fractures are likely to be generated in the flange portion 9.

Thus, to reduce generation of fractures and wrinkles when the press-formed product 1 is formed, it is thought to be important that material movement in the process of forming the convex curve site 11 and the concave curve site 13 is changed to reduce the line length difference generated between the top portion 3 and the flange portion 9 in the longitudinal direction so that tensile deformation and compressive deformation are prevented in the top portion 3 and the flange portion 9 in the forming process.

Figure 4:
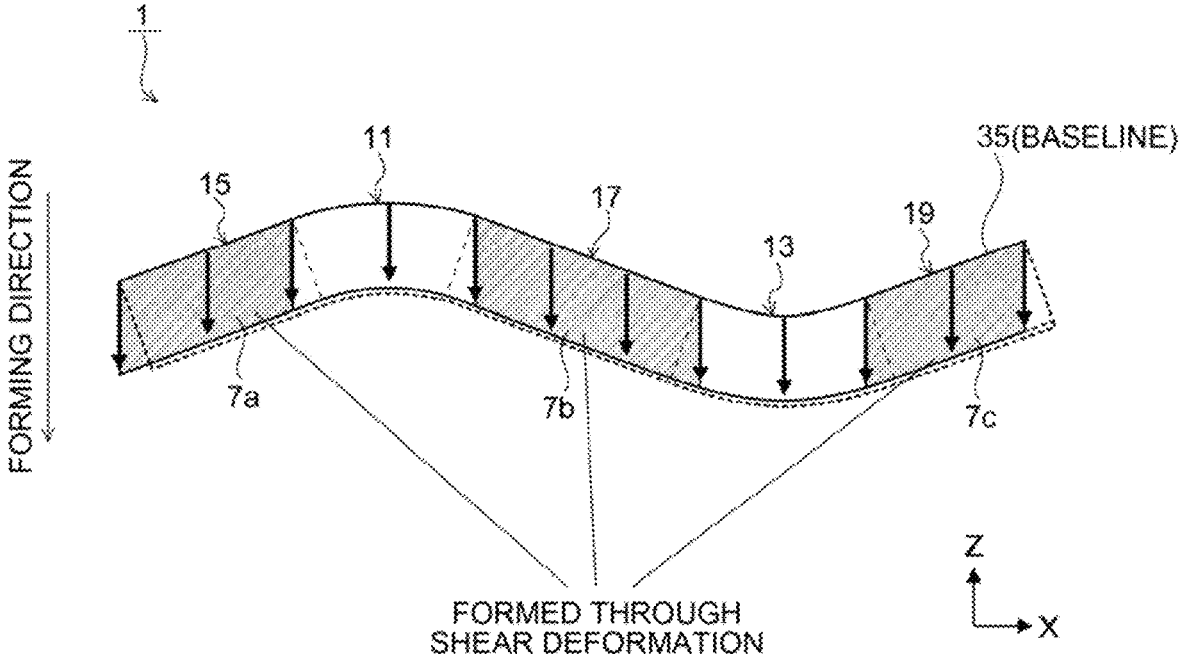
FIG. 4 is a diagram for description of a press-formed product in which shear deformation is caused to form a side wall portion in a background to the present invention.

Accordingly, the inventor carried out diligent studies of a specific method for reducing the line length difference. As a result, it was found that side wall portions 7*a*, 7*b*, and 7*c* of the straight portions 15, 17, and 19 need to be formed through shear deformation as illustrated in FIG. 4 to reduce the line length difference generated between the top portion 3 and the flange portion 9 in the longitudinal direction. Moreover, to form the side wall portions 7*a*, 7*b*, and 7*c* through shear deformation, it is needed to strongly sandwich the top portion 3 and the flange portion 9 and apply shear force to the side wall portions 7*a*, 7*b*, and 7*c*, but is not realistic. Thus, it was found that the process of forming the press-formed product 1 is divided into two processes: in the first process, a shape for controlling material movement to cause shear deformation in the process of forming the side wall portions 7*a*, 7*b*, and 7*c* is provided; and in the second process, the side wall portions 7*a*, 7*b*, and 7*c* are formed through pseudo shear deformation at sites provided with the shape for controlling material movement. Aspects of the present invention are achieved based on the above-described studies, and the press forming method according to the embodiment of the present invention will be described below.

<Press Forming Method>

Figure 1:
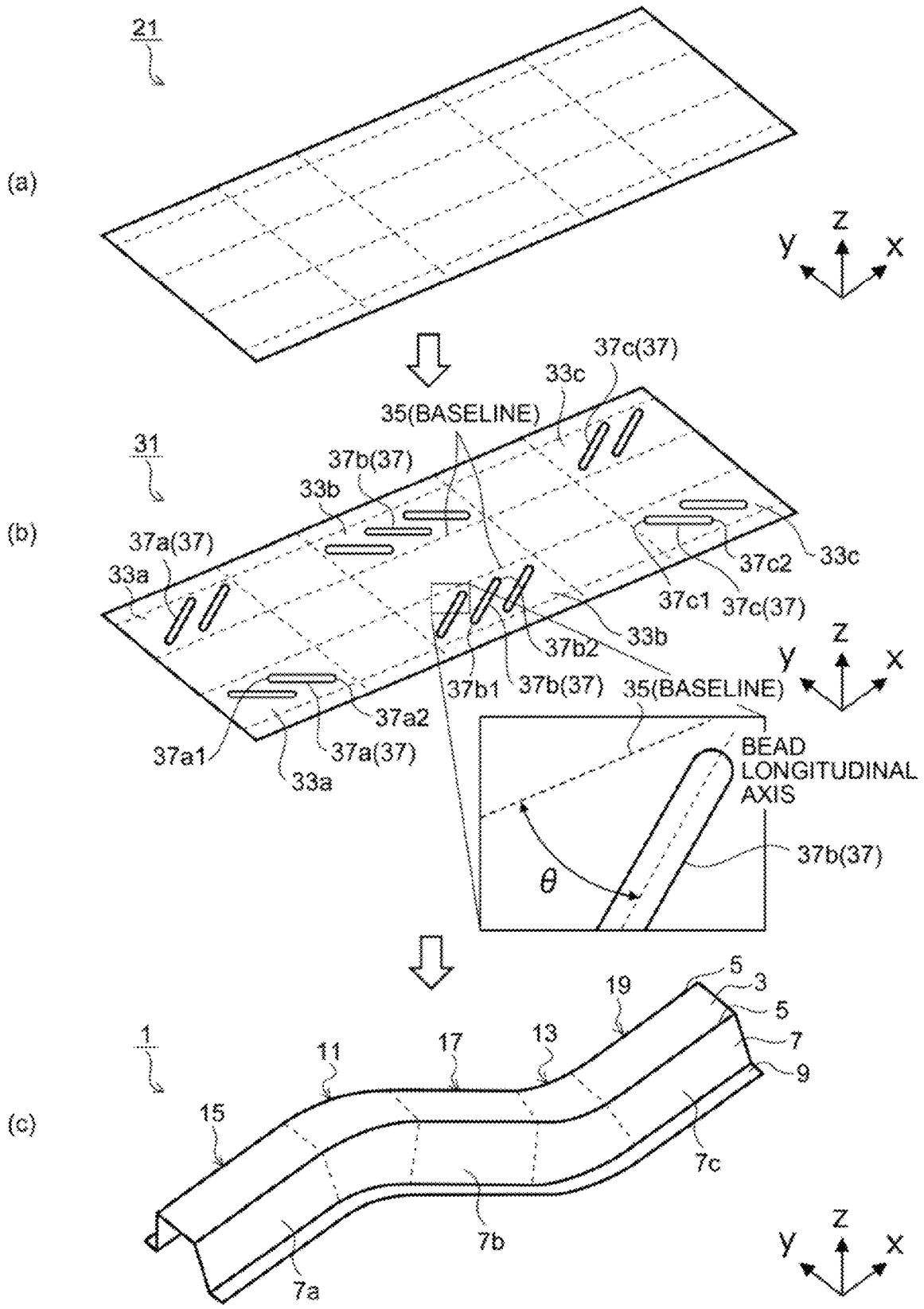
FIG. 1 is a diagram for description of forming processes in a press forming method according to an embodiment of the present invention ((a) a blank, (b) an intermediate formed product, and (c) a press-formed product).

The press forming method according to the present embodiment forms the press-formed product 1 illustrated in FIG. 2 and includes a preforming process of preforming a blank 21 into an intermediate formed product 31, and a final forming process of forming the intermediate formed product 31 into the press-formed product 1 as illustrated in FIG. 1. Each process will be described below.

<<Preforming Process>>

As illustrated in FIG. 1(*a*) to (*b*), the preforming process is the process of preforming the blank 21 into the intermediate formed product 31, and in the intermediate formed product 31, bead portions 37 (37*a*, 37*b*, and 37*c*) extending being tilted relative to a baseline 35 corresponding to the top side ridge line portion 5 are formed at side-wall corresponding surface portions 33*a* and 33*b* as sites corresponding to the side wall portions 7*a* and 7*b* (refer to FIG. 1(*c*)) in straight portions 15 and 17 on both sides of the convex curve site 11 in the press-formed product 1 in the longitudinal direction and at side-wall corresponding surface portions 33*b* and 33*c* as sites corresponding to the side wall portions 7*b* and 7*c* (refer to FIG. 1(*c*)) in the straight portions 17 and 19 on both sides of the concave curve site 13 in the longitudinal direction.

The bead portions 37*a* and 37*b* formed at the side-wall corresponding surface portions 33*a* and 33*b* on both sides of the convex curve site 11 in the longitudinal direction are tilted so that end parts 37*a*2 and 37*b*1 of the bead portions 37*a* and 37*b* positioned on the convex curve site 11 side along the long axes of the bead portions 37*a* and 37*b* are farther from the baseline 35 and the other end parts 37*al* and 37*b*2 positioned on the opposite side are closer to the baseline 35. The bead portions 37*b* and 37*c* formed at the side-wall corresponding surface portions 33*b* and 33*c* on both sides of the concave curve site 13 in the longitudinal direction are tilted so that end parts 37*b*2 and 37*cl* of the bead portions 37*b* and 37*c* positioned on the concave curve site 13 side along the long axes of the bead portions 37*b* and 37*c* are closer to the baseline 35 and the other end parts 37*b*1 and 37*c*2 positioned on the opposite side are farther from the baseline 35.

Figure 5:
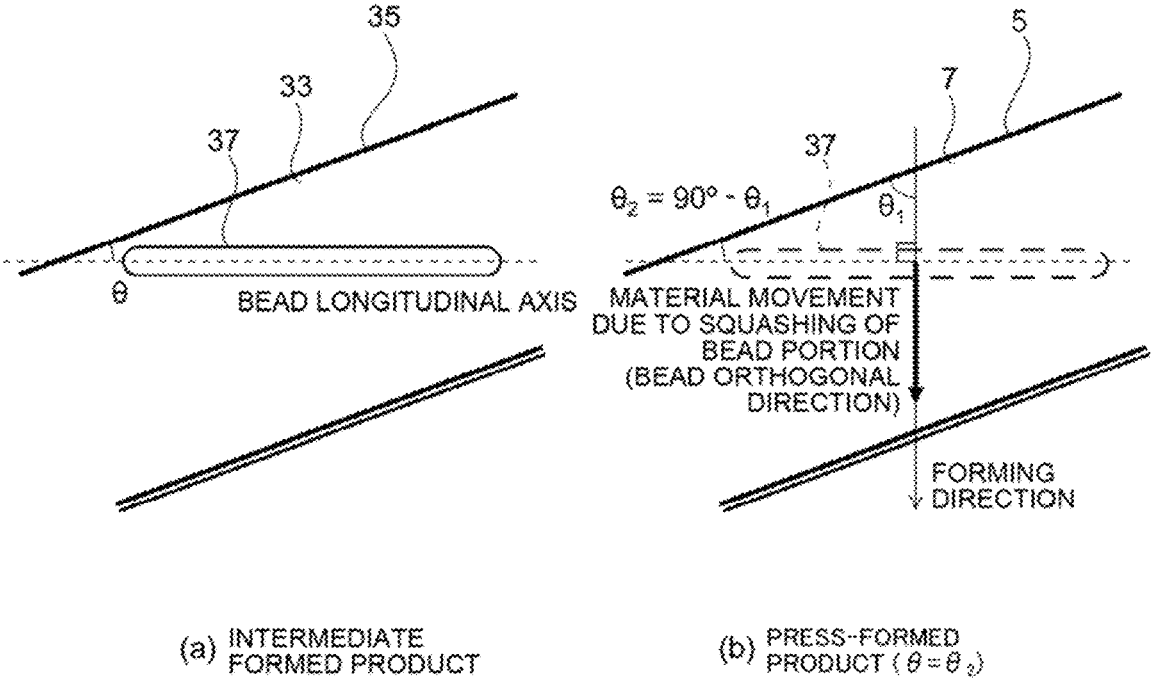
FIG. 5 is a diagram for description of material movement when a press-formed product is formed by the press forming method according to the embodiment of the present invention.

Note that, as for the tilt angle of each bead portion 37, an acute angle θ between the long axis of the bead portion 37 and the baseline 35 at a side-wall corresponding surface portion 33 at which the bead portion 37 is formed is desirably 5° to 60° as illustrated in FIG. 1(*b*). In addition, the angle θ between the long axis of the bead portion 37 and the baseline 35 desirably satisfies the relation of $\theta \geq \theta_2$ (=90°−$\theta_1$) when $\theta_1$ represents the acute angle between the forming direction of the press-formed product 1 in the final forming process to be described later and the top side ridge line portion 5 as illustrated in FIG. 5(*b*). Note that, a preferable range of the angle θ of the bead portion 37 is demonstrated in examples to be described later.

<<Final Forming Process>>

As illustrated in FIG. 1(*b*) to (*c*), the final forming process is the process of forming the press-formed product 1 by squashing each bead portion 37 in the intermediate formed product 31 and extending the side-wall corresponding surface portion 33 in a bead orthogonal direction orthogonal to the long axis of the bead portion 37 so that pseudo shear deformation occurs to the side-wall corresponding surface portion 33.

In the final forming process, the intermediate formed product 31 suffices to be subjected to formation using a die of press forming of the press-formed product 1, and accordingly, each bead portion 37 provided in the preforming process is squashed into a flat shape. In addition, the bead orthogonal direction of the bead portion 37 is aligned with the forming direction in the final forming process (refer to FIG. 5(*b*)) when the angle θ between the long axis of the bead portion 37 and the baseline 35 satisfies $\theta=\theta_2$ (refer to FIG. 5(*b*)) in the preforming process as described above, and thus when squashed in the final forming process, the bead portion 37 most efficiently extends in the bead orthogonal direction and can effectively cause pseudo shear deformation in the side-wall corresponding surface portion 33.

Figure 6:
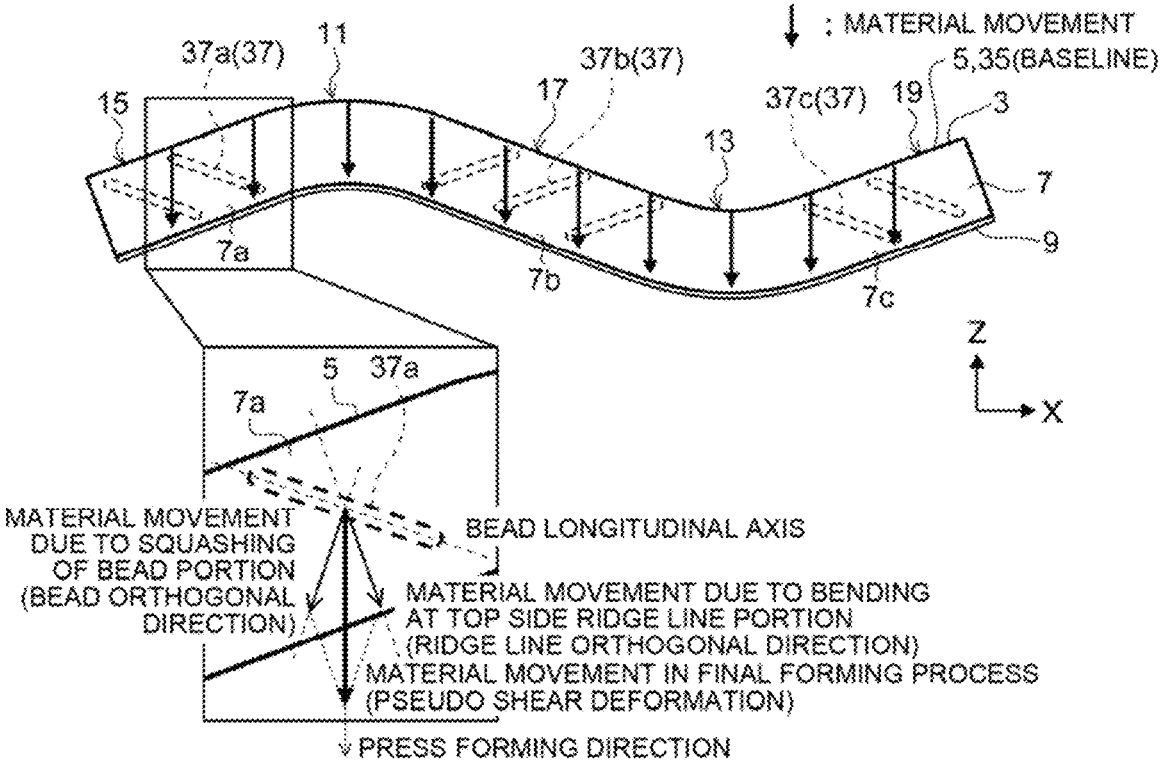
FIG. 6 is a diagram for description of material movement due to squashing of a bead portion formed in the intermediate formed product, material movement due to bending at a top side ridge line portion, and material movement (pseudo shear deformation) in a final forming process in the press forming method according to the embodiment of the present invention.

The following describes a mechanism for an effect of reducing fractures and wrinkles in accordance with aspects of the present invention. FIG. 6 illustrates material movement in the press forming method according to aspects of the present invention. In a normal press forming method, the material (blank) is bent at the top side ridge line portion 5 as described above, and thus the side wall portion 7 is formed as the material moves a direction orthogonal to the top side ridge line portion 5 (FIG. 3).

However, in the press forming method according to aspects of the present invention, when the intermediate formed product 31 formed through the preforming process is formed into the press-formed product 1, each bead portion 37 formed at the side-wall corresponding surface portion 33 is squashed and extended through deformation. In this case, the material of the bead portion 37 moves in the direction (bead orthogonal direction) orthogonal to the long axis of the bead portion 37. Accordingly, as illustrated in FIG. 6, the material moves to form the side wall portion 7 as a press forming direction component of material movement due to squashing of the bead portion 37 and a press forming direction component of material movement due to bending in a ridge line orthogonal direction at the top side ridge line portion 5 are added together and a press forming orthogonal direction component of material movement due to squashing of the bead portion 37 and a press forming orthogonal direction component of material movement due to bending in the ridge line orthogonal direction at the top side ridge line portion 5 are canceled. As a result, the line length difference generated between the top portion 3 and the flange portion 9 in the longitudinal direction is reduced, tensile deformation in the flange portion 9 at the concave curve site 13 and compressive deformation in the flange portion 9 at the convex curve site 11 are relaxed, and generation of fractures and wrinkles can be reduced.

In addition, since the press-formed product 1 is formed with relaxed compressive deformation in the flange portion 9 at the convex curve site 11, tensile deformation in the top portion 3 at the convex curve site 11 is relaxed, and thus fractures in the top portion 3 at the convex curve site 11 can be reduced. Moreover, since the press-formed product 1 is formed with relaxed tensile deformation in the flange portion 9 at the concave curve site 13, compressive deformation in the top portion 3 at the concave curve site 13 is relaxed, and thus wrinkles in the flange portion 9 at the concave curve site 13 can be reduced.

Note that, the technology disclosed in Patent Literature 5 described above seems similar to the press forming method according to aspects of the present invention in that convex or concave bead portions are preformed at a site corresponding to a side wall portion in a blank and squashed to form a target press-formed product.

However, in the technology disclosed in Patent Literature 5, bead portions are preliminarily formed directly at a site where fractures are generated, in other words, a side wall portion continuous with a top portion and a flange portion where wrinkles are generated in the first process, and then in the following second process, the bead portions are squashed to promote material inflow to a site where fractures are generated and material outflow from a site where wrinkles are generated.

On the contrary, in the press forming method according to aspects of the present invention, bead portions are formed in a side wall portion continuous with a top portion and a flange portion having no fractures nor wrinkles, and then in the final forming process as the second process, the bead portions are squashed to cause shear deformation in the side wall portion, thereby reducing compressive deformation and tensile deformation in the longitudinal direction to reduce generation of fractures and wrinkles. In this manner, the technology disclosed in Patent Literature 5 and the press forming method according to aspects of the present invention have different technological characteristics and obtain different effects.

Note that, each bead portion 37 formed in the preforming process suffices to be tilted relative to the baseline 35 as described above, but the angle θ of the bead portion 37 is preferably 5° to 60° inclusive.

In particular, in a case of $\theta \geq \theta_2$ (=90°−$\theta_1$), material movement in a press forming direction due to squashing of the bead portion 37 and material movement in the press forming direction due to bending in the ridge line orthogonal direction at the top side ridge line portion 5 are added together, and material movement in a press forming orthogonal direction due to squashing the bead portion 37 and material movement in the press forming orthogonal direction due to bending in the ridge line orthogonal direction at the top side ridge line portion 5 are canceled, and accordingly, the amount of shear deformation in each surface portion corresponding to a side wall portion can be increased, thereby further making it possible to reduce compressive deformation in the flange portion 9 at the convex curve site 11 and tensile deformation in the flange portion 9 at the concave curve site 13.

In addition, in a case of $\theta=\theta_2$ ($=90°-\theta_1$), the forming direction is aligned with a direction in which the bead portion is squashed and extended as illustrated in FIG. 5(*b*), and thus the bead portion 37 can be most efficiently extended in the bead orthogonal direction in the final forming process.

As described above, aspects of the present invention can move the material in a desired direction during forming in the final forming process by changing the angle θ between each bead portion 37 and the baseline 35 in the intermediate formed product 31, and thus are applicable to various kinds of forming conditions and the material strength of a blank used in forming.

Note that, the present invention is not limited to a case in which the intermediate formed product 31 having a shape in which only the bead portions 37 are provided to a flat plate blank as illustrated in FIG. 1(*b*) is formed through the preforming process, but the bead portions may be provided to a product having a shape close to that of the press-formed product 1 to be formed in the final forming process.

Figure 7:
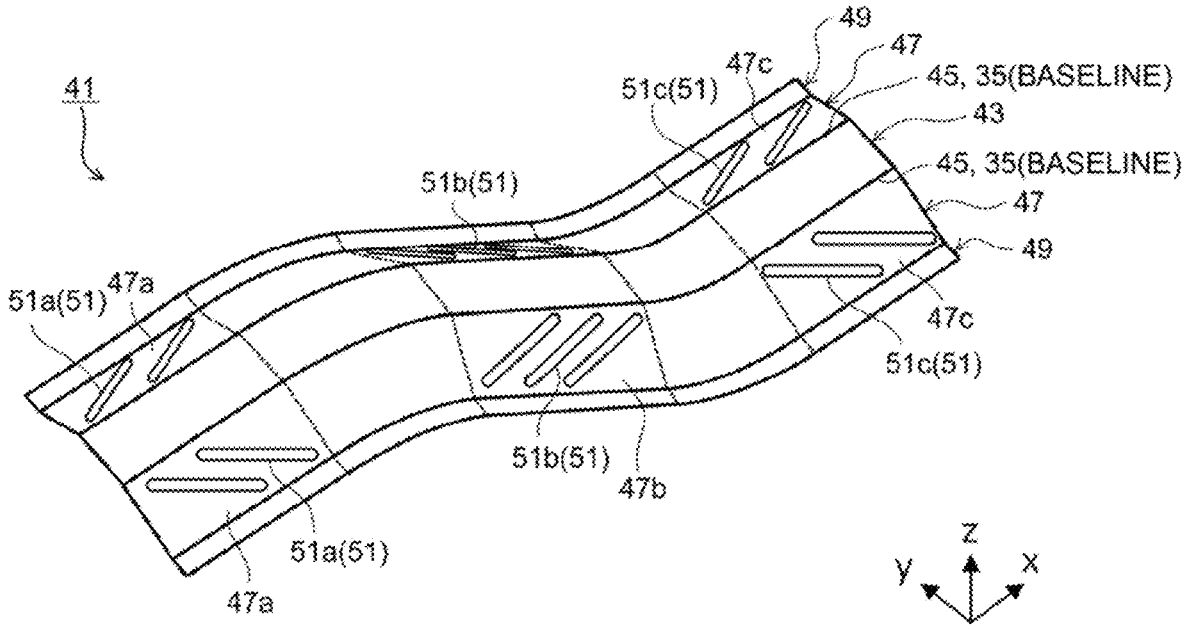
FIG. 7 is a diagram (1) illustrating another aspect of the intermediate formed product formed through a preforming process in the press forming method according to aspects of the present invention.

For example, an intermediate formed product 41 that includes a top portion 43 curved in a convex and concave shape in the height direction, a side-wall corresponding surface portion 47 continuous with the top portion 43 through a top side ridge line portion 45, and a flange portion 49 and in which bead portions 51 are formed at the side-wall corresponding surface portion 47 may be formed as illustrated in FIG. 7.

Figure 8:
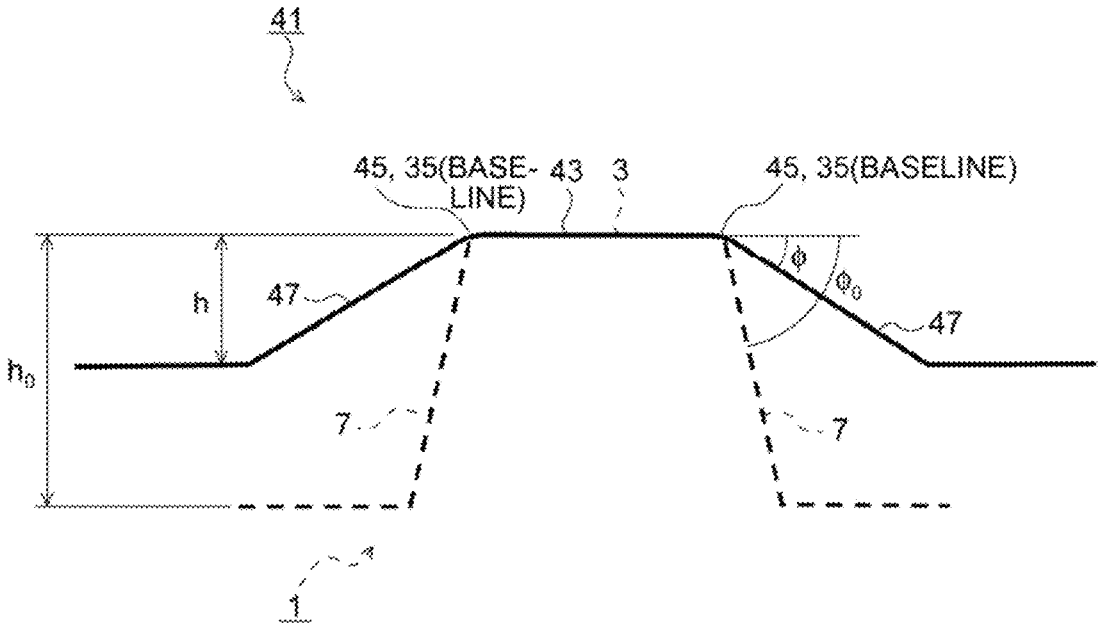
FIG. 8 is a diagram (2) illustrating still another aspect of the intermediate formed product formed through the preforming process in the press forming method according to aspects of the present invention.

FIG. 8 illustrates cross-sectional views of the intermediate formed product 41 and the press-formed product 1. The side-wall corresponding surface portion 47 can be formed at the side wall portion 7 as the bead portions 51 are squashed in the final forming process when an angle φ of the side-wall corresponding surface portion 47 in the intermediate formed product 41 is smaller than an angle φ of the side wall portion 7 in the press-formed product 1 and a side wall height h of the intermediate formed product 41 is lower than a side wall height $h_0$ of the press-formed product 1.

Moreover, since the top side ridge line portion 45 in the intermediate formed product 41 has a bent shape and connects the top portion 43 and the side-wall corresponding surface portion 47 (refer to FIG. 8), the top side ridge line portion 45 and each bead portion 51 at the side-wall corresponding surface portion 47 are not positioned on an identical plane.

Figure 9:
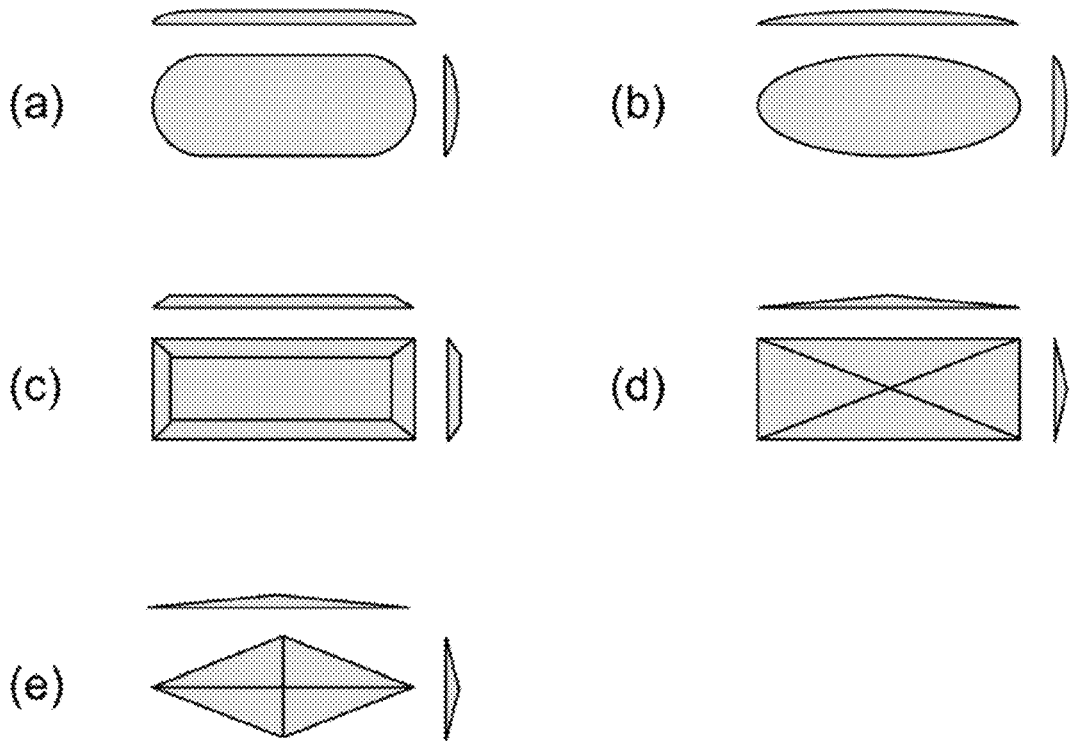
FIG. 9 is a diagram illustrating specific exemplary shapes of the bead portion formed in the intermediate formed product through the preforming process in the press forming method according to aspects of the present invention.

Note that, although each bead portion 37 (FIG. 1(*b*)) or each bead portion 51 (FIG. 7) has an oval shape in plan view (FIG. 9(*a*)) in the above description, the present invention is not limited to this shape but is also applicable to shapes as illustrated in FIG. 9(*b*) to (*e*).

Moreover, the height and number of bead portions formed in the intermediate formed product in the preforming process are not limited, but when a larger number of bead portions having higher heights are formed, each side-wall corresponding surface portion at which the bead portions are formed has a larger section line length so that material movement when the bead portions are formed into flat shapes in the final forming process can be increased, thereby achieving a more preferable effect of reducing fractures and wrinkles. Note that, each bead portion may have a convex or concave section orthogonal to the long axis. In addition, the long axis of a convex bead portion and the long axis of a concave bead portion may be alternately formed. The long axes of the bead portions are preferably parallel to each other.

The bead portions are desirably formed at sites, such as the straight portions 15, 17, and 19 illustrated in FIG. 1, which are adjacent to the convex curve site 11 and the concave curve site 13 where fractures and wrinkles are generated, and at sites having small curvature. Moreover, end parts of each bead portion formed in the intermediate formed product may be slightly positioned inside the side-wall corresponding surface portion of the convex curve site and inside the side-wall corresponding surface portion of the concave curve site.

In addition, crash forming and deep drawing can be each applied as press techniques in the preforming process and the final forming process in accordance with aspects of the present invention.

Figure 10:
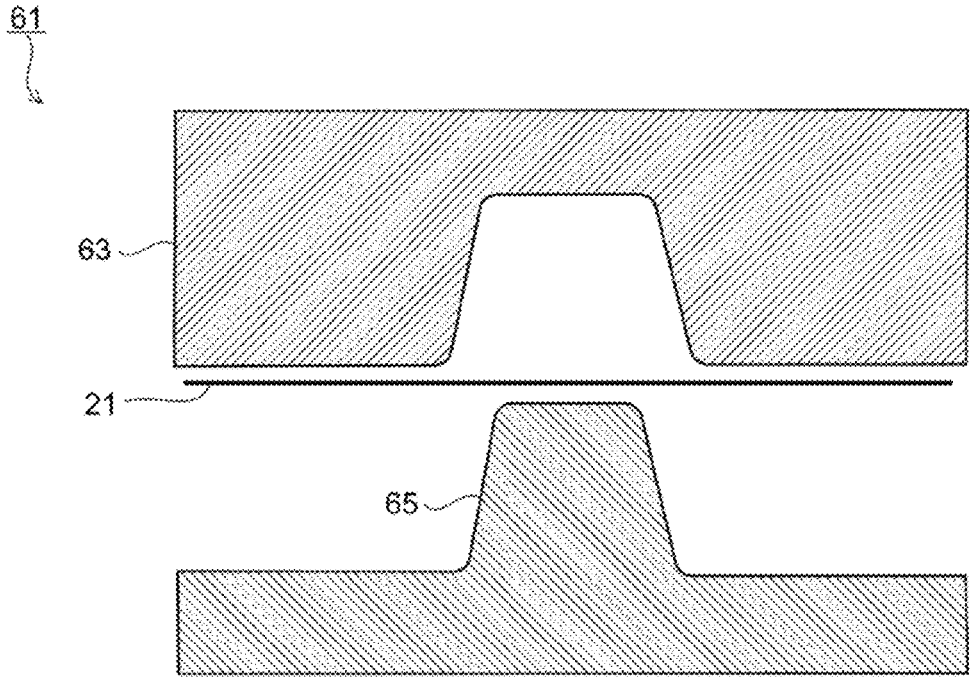
FIG. 10 is a diagram for description of crash forming applied in the press forming method according to aspects of the present invention.
Figure 11:
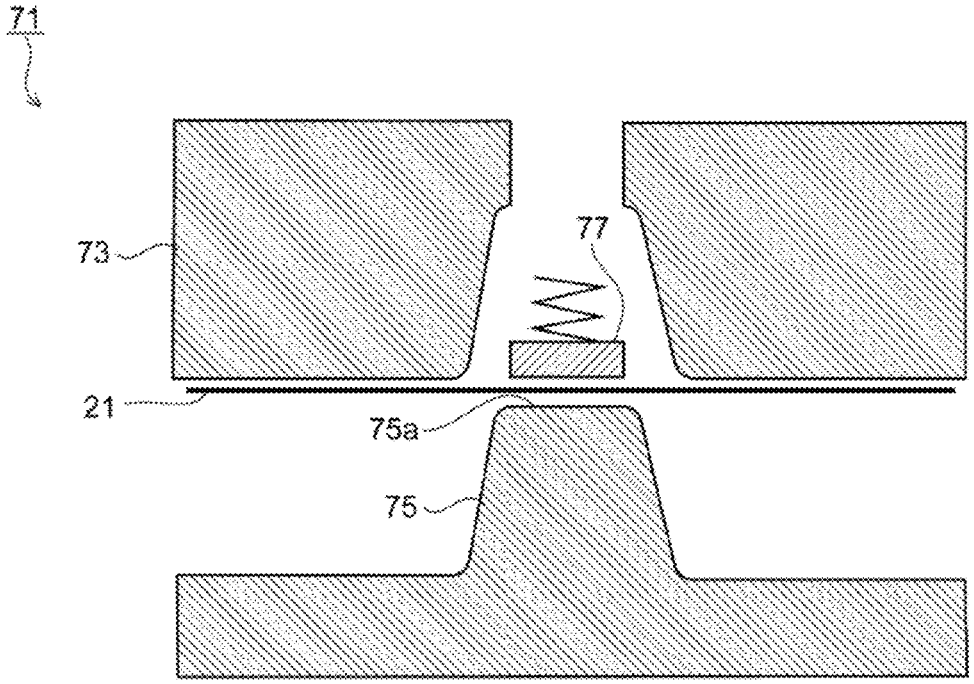
FIG. 11 is a diagram for description of crash forming using a pad and applied in the press forming method according to aspects of the present invention.

FIG. 10 illustrates an exemplary cross-sectional view of a die of press forming 61 and the blank 21 in the crash forming. The crash forming is a technique in which the blank 21 is formed being sandwiched between a die 63 as an upper mold and a punch 65 as a lower mold, and is applicable to each of the preforming process and the final forming process according to aspects of the present invention. Alternatively, aspects of the present invention may use a die of press forming 71 including a pad 77 as illustrated in FIG. 11 and perform the crash forming with a die 73 and a punch 75 while a surface portion corresponding to the top portion in the blank 21 is pressed by the pad 77 paired with a punch bottom part 75*a* of the punch 75.

Figure 12:
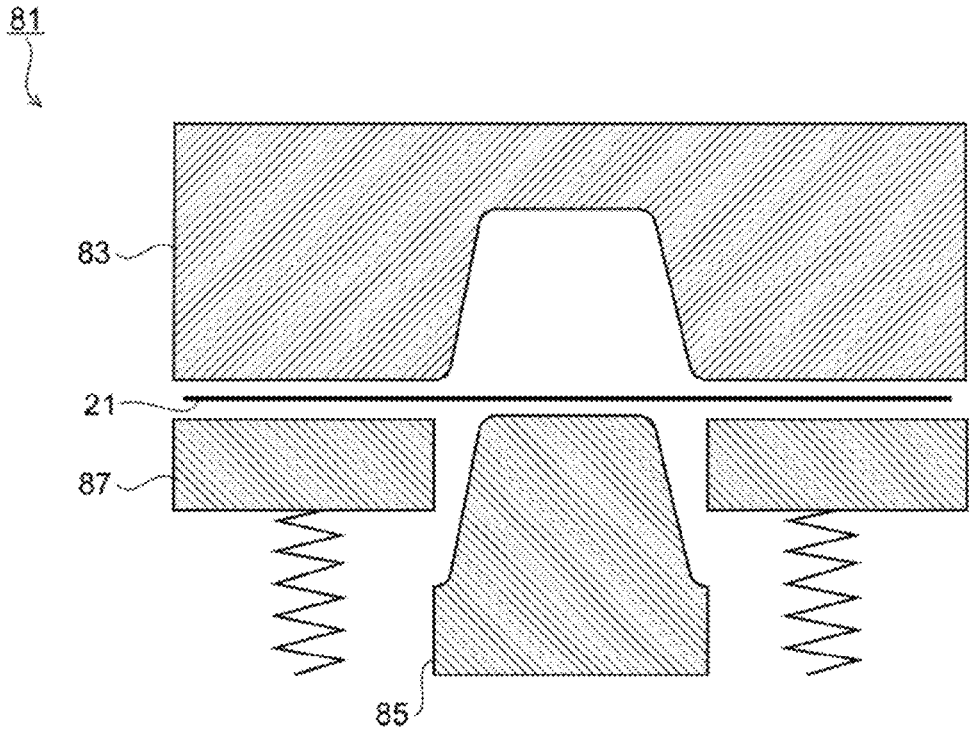
FIG. 12 is a diagram for description of deep drawing applied in the press forming method according to aspects of the present invention.
Figure 13:
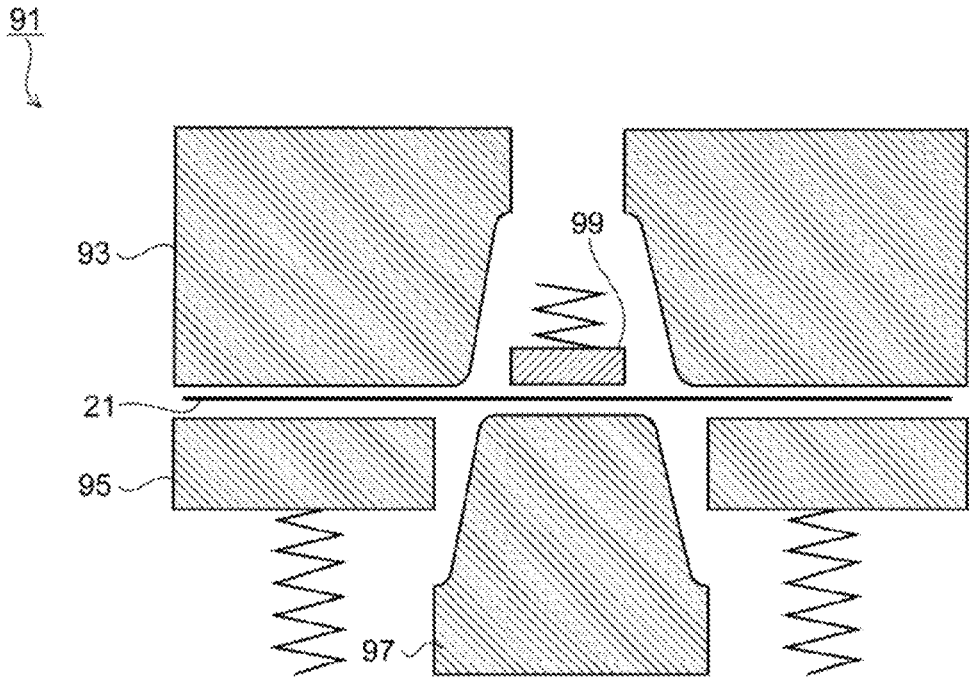
FIG. 13 is a diagram for description of deep drawing using a pad and applied in the press forming method according to aspects of the present invention.

FIG. 12 illustrates a cross-sectional view of a die of press forming 81 and the blank 21 in the deep drawing. The deep drawing is a technique in which the blank 21 is formed by moving down (relatively moving) a die 83 and a blank holder 85 toward a punch 87 side while the blank 21 is held by the die 83 and the blank holder 85, and is applicable to each of the preforming process and the final forming process according to aspects of the present invention. Alternatively, aspects of the present invention may use a die of press forming 91 including a pad 99 as illustrated in FIG. 13 and perform the deep drawing while a surface portion corresponding to the top portion in the blank 21 is pressed by the pad 99 paired with a punch bottom part 97*a* of a punch 97 and the blank 21 is held by a die 93 and a blank holder 95.

Note that, the press forming method according to aspects of the present invention is not limited to a steel sheet but is also applicable to a metal plate. Examples of metal plates include a coated steel sheet, an aluminum sheet, and an aluminum alloy sheet.

EXAMPLE

A specific press forming experiment on effects of the press forming method according to aspects of the present invention was performed as described below.

Figure 14:
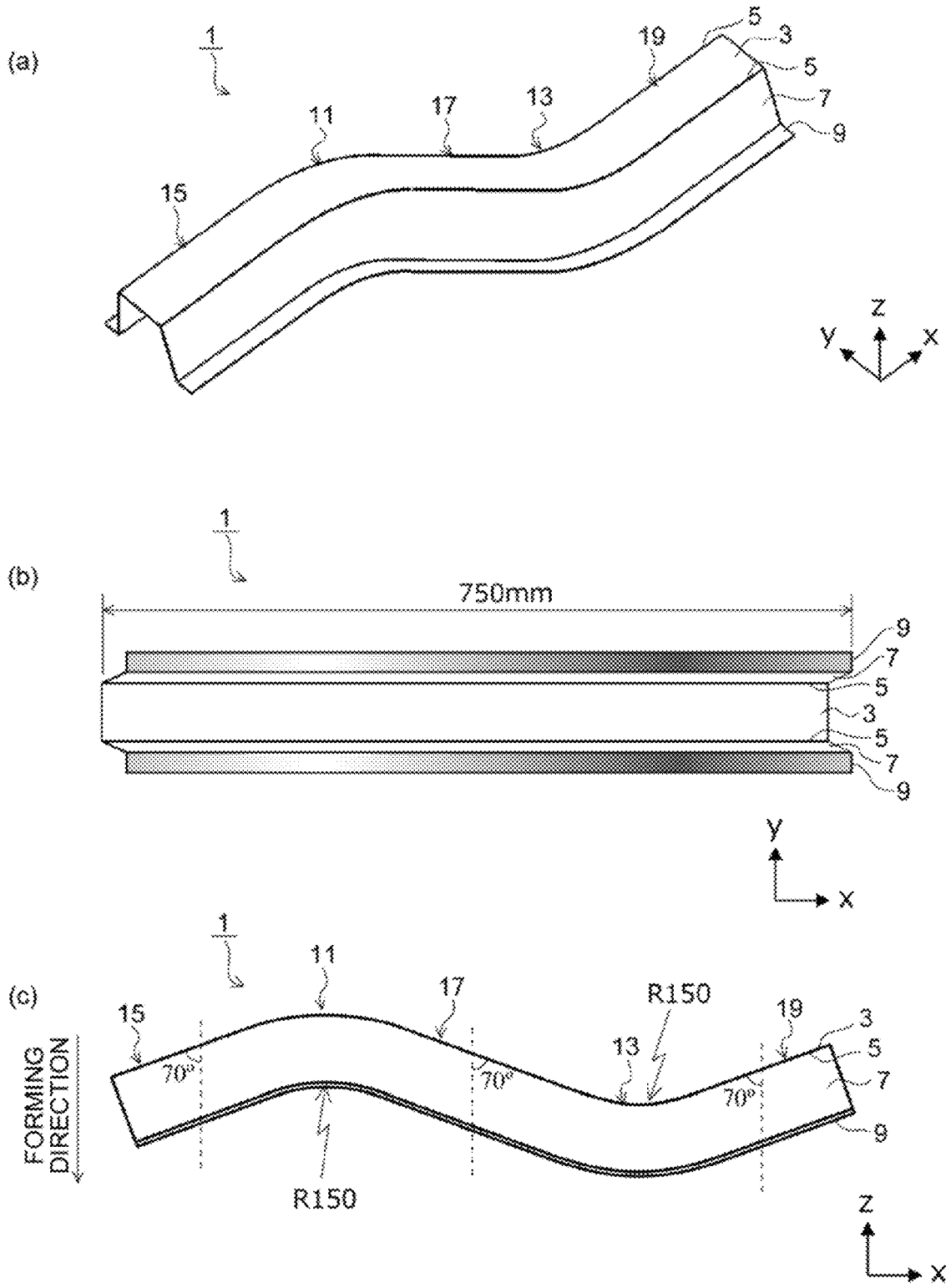
FIG. 14 is a diagram illustrating a press-formed product as a forming target in an example ((a) a perspective view, (b) a top view, and (c) a side view).
Figure 15:
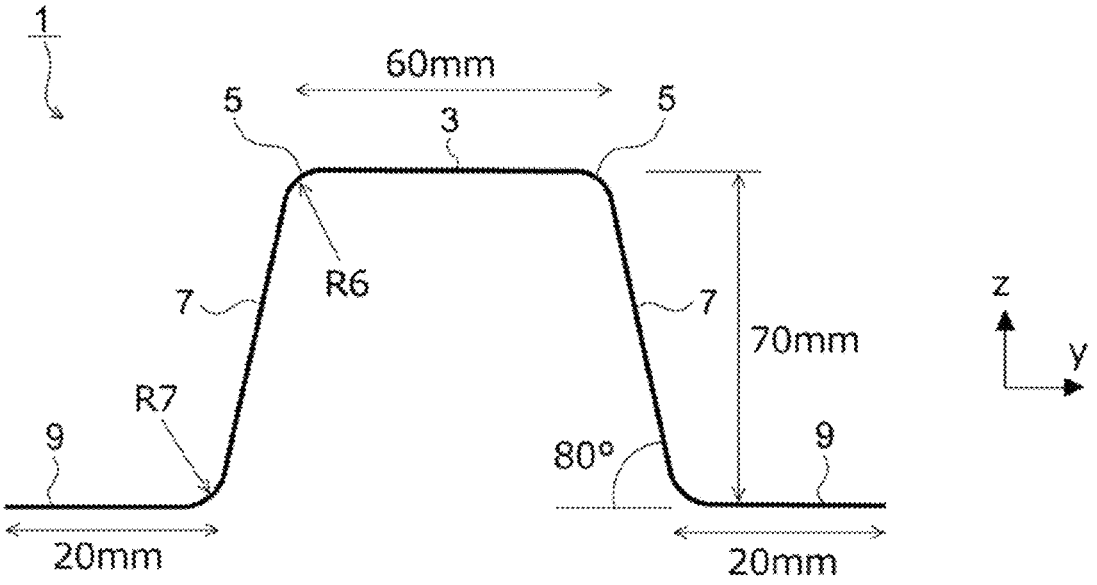
FIG. 15 is a cross-sectional view of the press-formed product as a forming target in the example.

In the experiment, the press-formed product 1 having a hat-shaped cross section and including the convex curve site 11 curved in a convex shape and the concave curve site 13 curved in a concave shape in the height direction was press-formed as illustrated in FIGS. 14 and 15. In the press-formed product 1, the curvature radius of the convex curve site 11 and the curvature radius of the concave curve site 13 in the Z-axis direction were R150. The acute angle $\theta_1$ (FIG. 5(*b*)) between the top side ridge line portion 5 and the forming direction at the side wall portion 7 of each of the straight portions 15, 17, and 19 provided adjacent to the convex curve site 11 and the concave curve site 13 in the longitudinal direction was 70°. Note that, in the experiment, the material was a 1180 MPa grade steel sheet having a plate thickness of 1.2 mm.

In the present example, an example of the present invention was obtained by forming an intermediate formed product through the preforming process and subsequently forming the intermediate formed product into a press-formed product through the final forming process according to aspects of the present invention. The press technique in the preforming process was the crash forming (refer to FIG. 10) or the deep drawing (refer to FIG. 12), and the press technique in the final forming process was the crash forming or the deep drawing. The preforming process and the final forming process were also studied for a case in which forming was performed by using a pad (refer to FIGS. 11 and 13). In the deep drawing, a blank holder load was 50 tonf, and a pad load was 10 tonf when the pad was used.

The preforming process was performed in two cases, namely, a case in which the intermediate formed product 31 having a shape in which only the bead portions 37 are provided to a blank having a flat plate shape as illustrated in FIG. 1(*b*) is formed and a case in which the intermediate formed product 41 in which the angle φ between the top portion 43 and the side-wall corresponding surface portion 47 is 30° as illustrated in FIGS. 7 and 8 is formed. Then, in each of the intermediate formed product 31 and the intermediate formed product 41, the angle θ (FIG. 5(*a*)) between the long axis of each bead portion 37 and the baseline 35 corresponding to the top side ridge line portion 5 and the angle θ between the bead portion 51 and a baseline corresponding to the top side ridge line portion 45 each had the five values of 3°, 5°, 20°, 60°, and 70°.

Moreover, a conventional example is an example in which the press-formed product 1 was formed through one process without forming bead portions, and a comparative example is an example in which the press-formed product 1 was formed through the two processes of the preforming process and the final forming process similarly to the example of the present invention and the angle θ (refer to FIG. 1(*b*)) of each bead portion formed in the intermediate formed product in the preforming process was out of the preferable range according to aspects of the present invention.

In the present example, formability was evaluated based on the existence of fractures and wrinkles in the flange portion 9 and the top portion 3 in the press-formed product 1. In fracture evaluation, the existence of fractures in the top portion 3 at the convex curve site 11 and the flange portion 9 at the concave curve site 13 was observed, a cross was provided when fractures existed, a triangle was provided when no fractures existed but necking due to plate thickness decrease existed, and a circle was provided when no fractures nor necking existed. In wrinkle evaluation, the existence of wrinkles in the flange portion 9 at the convex curve site 11 and the top portion 3 at the concave curve site 13 was observed, a cross was provided when significant wrinkles existed, a triangle was provided when minute wrinkles existed, and a circle was provided when no wrinkles existed. Table 1 lists forming conditions and formability evaluation results.

TABLE 1

| | | Forming Conditions | | | | | | Formability Evaluation | | | |
|---|---|---|---|---|---|---|---|---|---|---|---|
| | | | | | | | | Fracture (○: None, Δ: Necking, ×: Exist) | | Wrinkle (○: None, Δ: Minute, ×: Exist) | |
| | | Forming Method | | Pad Existence | | Intermediate Formed Product | Bead Tilt | Convex Curved Site | Concave Curved Site | Convex Curved Site | Concave Curved Site |
| | | Pre-forming | Final Forming | Pre-forming | Final Forming | Side Wall Angle (°) | Angle (°) | Site Top Portion | Flange Portion | Flange Portion | Top Portion |
| | Conventional Example 1 | — | Crash Forming | — | No | — | — | Δ | Δ | × | × |
| | Conventional Example 2 | — | Deep Drawing | — | ↑ | — | — | × | ○ | ○ | × |
| | Conventional Example 3 | — | Crash Forming | — | Yes | — | — | Δ | × | × | ○ |
| | Conventional Example 4 | — | Deep Drawing | — | ↑ | — | — | × | Δ | ○ | Δ |
| A | Example 1 | Crash Forming | Crash Forming | No | No | 0 | 3 | Δ | Δ | Δ | Δ |
| | Example 2 | ↑ | ↑ | ↑ | ↑ | ↑ | 5 | ○ | Δ | Δ | Δ |
| | Example 3 | ↑ | ↑ | ↑ | ↑ | ↑ | 20 | ○ | ○ | Δ | ○ |
| | Example 4 | ↑ | ↑ | ↑ | ↑ | ↑ | 60 | ○ | Δ | Δ | ○ |
| | Example 5 | ↑ | ↑ | ↑ | ↑ | ↑ | 70 | Δ | Δ | Δ | Δ |
| B | Example 11 | ↑ | Deep Drawing | ↑ | ↑ | ↑ | 3 | Δ | ○ | ○ | Δ |
| | Example 12 | ↑ | ↑ | ↑ | ↑ | ↑ | 5 | Δ | ○ | ○ | Δ |
| | Example 13 | ↑ | ↑ | ↑ | ↑ | ↑ | 20 | ○ | ○ | ○ | Δ |
| | Example 14 | ↑ | ↑ | ↑ | ↑ | ↑ | 60 | Δ | ○ | ○ | Δ |
| | Example 15 | ↑ | ↑ | ↑ | ↑ | ↑ | 70 | Δ | ○ | ○ | Δ |
| C | Example 21 | ↑ | Crash Forming | ↑ | Yes | ↑ | 3 | Δ | Δ | Δ | ○ |
| | Example 22 | ↑ | ↑ | ↑ | ↑ | ↑ | 5 | ○ | Δ | Δ | ○ |
| | Example 23 | ↑ | ↑ | ↑ | ↑ | ↑ | 20 | ○ | ○ | Δ | ○ |
| | Example 24 | ↑ | ↑ | ↑ | ↑ | ↑ | 60 | ○ | Δ | Δ | ○ |
| | Example 25 | ↑ | ↑ | ↑ | ↑ | ↑ | 70 | Δ | Δ | Δ | Δ |
| D | Example 31 | ↑ | Deep Drawing | ↑ | ↑ | ↑ | 3 | Δ | ○ | ○ | Δ |
| | Example 32 | ↑ | ↑ | ↑ | ↑ | ↑ | 5 | Δ | ○ | ○ | Δ |
| | Example 33 | ↑ | ↑ | ↑ | ↑ | ↑ | 20 | ○ | ○ | ○ | ○ |
| | Example 34 | ↑ | ↑ | ↑ | ↑ | ↑ | 60 | ○ | ○ | ○ | Δ |
| | Example 35 | ↑ | ↑ | ↑ | ↑ | ↑ | 70 | Δ | ○ | ○ | Δ |

TABLE 1-continued

| | | Forming Conditions | | | | | | Formability Evaluation | | | |
|---|---|---|---|---|---|---|---|---|---|---|---|
| | | | | | | | | Fracture (○: None, Δ: Necking, ×: Exist) | | Wrinkle (○: None, Δ: Minute, ×: Exist) | |
| | | Forming Method | | Pad Existence | | Intermediate Formed Product | Bead Tilt | Convex Curved Site | Concave Curved Site | Convex Curved Site | Concave Curved Site |
| | | Pre-forming | Final Forming | Pre-forming | Final Forming | Side Wall Angle (°) | Angle (°) | Top Portion | Flange Portion | Flange Portion | Top Portion |
| E | Example 41 | Deep Drawing | Crash Forming | ↑ | ↑ | 30 | 3 | Δ | Δ | Δ | ○ |
| | Example 42 | ↑ | ↑ | ↑ | ↑ | ↑ | 5 | ○ | Δ | Δ | ○ |
| | Example 43 | ↑ | ↑ | ↑ | ↑ | ↑ | 20 | ○ | ○ | ○ | ○ |
| | Example 44 | ↑ | ↑ | ↑ | ↑ | ↑ | 60 | ○ | Δ | ○ | ○ |
| | Example 45 | ↑ | ↑ | ↑ | ↑ | ↑ | 70 | Δ | Δ | Δ | Δ |
| | Example 51 | Deep Drawing | Crash Forming | Yes | Yes | 30 | 20 | ○ | ○ | ○ | ○ |

In Table 1, A to E in the leftmost column denote groups of examples and comparative examples in each of which the press techniques and the pad existence in the preforming process and the final forming process were identical.

In Group A, the intermediate formed product 31 of a flat plate shape was formed through the preforming process, the crash forming was employed in the preforming process, the crash forming was employed in the final forming process, and no pad was used in the preforming process and the final forming process (Examples 1 to 5).

In Conventional Example 1 in which the press-formed product 1 was formed through one process by the crash forming with no pad in the final forming process as well, necking due to plate thickness decrease occurred to the top portion 3 at the convex curve site 11 and the flange portion 9 at the concave curve site 13. In comparison with Conventional Example 1, in Examples 1 and 5, necking due to plate thickness decrease occurred to the top portion 3 at the convex curve site 11 and the flange portion 9 at the concave curve site 13. Moreover, in Examples 2 and 4, no fractures nor necking occurred to the top portion 3 at the convex curve site 11, but necking occurred to the flange portion 9 at the concave curve site 13. In addition, in Example 3 in which the angle θ of each bead portion 37 was 20°, no fractures nor necking occurred to the top portion 3 at the convex curve site 11 and the flange portion 9 at the concave curve site 13.

Moreover, in Conventional Example 1, clear large wrinkles occurred to the flange portion 9 at the convex curve site 11 and the top portion 3 at the concave curve site 13. In comparison with Conventional Example 1, in Examples 1, 2, and 5, minute wrinkles occurred to the flange portion 9 at the convex curve site 11 and the top portion 3 at the concave curve site 13. Moreover, in Examples 3 and 4, minute wrinkles occurred to the flange portion 9 at the convex curve site 11, but no wrinkles occurred to the top portion 3 at the concave curve site 13.

In Group B, the intermediate formed product 31 of a flat plate shape was formed through the preforming process, the crash forming was employed in the preforming process, the deep drawing was employed in the final forming process, and no pad was used in the preforming process and the final forming process (Examples 11 to 15).

In Conventional Example 2 in which the press-formed product 1 was formed through one process by the deep drawing with no pad in the final forming process as well, clear fractures occurred to the top portion 3 at the convex curve site 11. In comparison with Conventional Example 2, in Examples 11, 12, 14, and 15, necking occurred to the top portion 3 at the convex curve site 11.

Moreover, in Conventional Example 2, clear wrinkles occurred to the top portion 3 at the concave curve site 13. In comparison with Conventional Example 2, in Examples 11 to 15, minute wrinkles occurred to the top portion 3 at the concave curve site 13.

In Group C, the intermediate formed product 31 of a flat plate shape was formed through the preforming process, the crash forming was employed in the preforming process, the crash forming was employed in the final forming process, no pad was used in the preforming process, and a pad was used in the final forming process (Examples 21 to 25).

In Conventional Example 3 in which the press-formed product 1 was formed through one process by the crash forming with a pad in the final forming process as well, necking due to plate thickness decrease occurred to the top portion 3 at the convex curve site 11, and fractures occurred to the flange portion 9 at the concave curve site 13. In comparison with Conventional Example 3, in Examples 21 and 25, necking occurred to the top portion 3 at the convex curve site 11 and the flange portion 9 at the concave curve site 13. Moreover, in Examples 22 and 24, no fractures nor necking occurred to the top portion 3 at the convex curve site 11, but necking occurred to the flange portion 9 at the concave curve site 13. In addition, in Example 23 in which the angle θ of each bead portion 37 was 20°, no fractures nor necking occurred to the top portion 3 at the convex curve site 11 and the flange portion 9 at the concave curve site 13.

Moreover, in Conventional Example 3, clear large wrinkles occurred to the flange portion 9 at the convex curve site 11. In comparison with Conventional Example 3, in Examples 21 to 25, minute wrinkles occurred to the flange portion 9 at the convex curve site 11. Moreover, in Example 25, minute wrinkles occurred to the top portion 3 at the concave curve site 13.

In Group D, the intermediate formed product 31 of a flat plate shape was formed through the preforming process, the crash forming was employed in the preforming process, the deep drawing was employed in the final forming process, no pad was used in the preforming process, and a pad was used in the final forming process (Examples 31 to 35).

In Conventional Example 4 in which the press-formed product 1 was formed through one process by the deep drawing with a pad in the final forming process as well, fractures occurred to the top portion 3 at the convex curve site 11 and necking occurred to the flange portion 9 at the concave curve site 13. In comparison with Conventional Example 4, in Examples 31, 32, and 35, necking occurred to the top portion 3 at the convex curve site 11. Moreover, in Examples 33 and 34, no fractures nor necking occurred to the top portion 3 at the convex curve site 11.

Moreover, in Conventional Example 4, minute wrinkles occurred to the top portion 3 at the concave curve site 13. In comparison with Conventional Example 4, in Examples 31, 32, 34, and 35, minute wrinkles occurred to the top portion 3 at the concave curve site 13. Moreover, in Example 33, no wrinkles occurred to the flange portion 9 at the convex curve site 11 and the top portion 3 at the concave curve site 13.

In Group E, the intermediate formed product 41 in which the angle φ of the side-wall corresponding surface portion 47 was 30° was formed through the preforming process, no pad was used in the preforming process, and a pad was used in the final forming process (Examples 41 to 45).

In Conventional Example 3 in which the press-formed product 1 was formed through one process by the crash forming with a pad in the final forming process as well, necking due to plate thickness decrease occurred to the top portion 3 at the convex curve site 11, and fractures occurred to the flange portion 9 at the concave curve site 13. In comparison with Conventional Example 3, in Examples 41 and 45, necking occurred to the top portion 3 at the convex curve site 11 and the flange portion 9 at the concave curve site 13. Moreover, in Examples 42 and 44, necking occurred to the flange portion 9 at the concave curve site 13. In addition, in Example 43, no fractures nor necking occurred to the top portion 3 at the convex curve site 11 and the flange portion 9 at the concave curve site 13.

Moreover, in Conventional Example 3, clear large wrinkles occurred to the flange portion 9 at the convex curve site 11. In comparison with Conventional Example 3, in Examples 41 and 42, minute wrinkles occurred to the flange portion 9 at the convex curve site 11. Moreover, in Example 45, minute wrinkles occurred to the top portion 3 at the concave curve site 13. Moreover, in Examples 43 and 44, no wrinkles occurred to the flange portion 9 at the convex curve site 11 and the top portion 3 at the concave curve site 13.

Comparison between Examples 43 and 51 for an effect of the existence of a pad in the preforming process found that fractures and wrinkles were both prevented at the convex curve site 11 and the concave curve site 13 in Example 51 in which a pad was used in the preforming process, similarly to Example 43 in which no pad was used in the preforming process.

As described above, it is indicated that, with the press forming method according to aspects of the present invention, it is possible to form a press-formed product curved in convex and concave shapes in the height direction with reduced fractures and wrinkles.

INDUSTRIAL APPLICABILITY

According to aspects of the present invention, it is possible to provide a press forming method capable of obtaining a favorable press-formed product without generating fractures nor wrinkles in press forming of a press-formed product including a top portion, a side wall portion and a flange portion, and curved in convex and concave shapes in the height direction at places in the longitudinal direction in side view.

REFERENCE SIGNS LIST

1 press-formed product
3 top portion
5 top side ridge line portion
7, 7*a*, 7*b*, 7*c* side wall portion
9 flange portion
11 convex curve site
13 concave curve site
15, 17, 19 straight portion
21 blank
31 intermediate formed product
33, 33*a*, 33*b*, 33*c* side-wall corresponding surface portion
35 baseline
37, 37*a*, 37*b*, 37*c* bead portion
37*a*1, 37*a*2, 37*b*1, 37*b*2, 37*c*1, 37*c*2 end part
41 intermediate formed product
43 top portion
45 top side ridge line portion
47, 47*a*, 47*b*, 47*c* side-wall corresponding surface portion
49 flange portion
51, 51*a*, 51*b*, 51*c* bead portion
61 die of press forming (crash forming)
63 die
65 punch
71 die of press forming (crash forming)
73 die
75 punch
75*a* punch bottom part
77 pad
81 die of press forming (deep drawing)
83 die
85 blank holder
87 punch
91 die of press forming (deep drawing)
93 die
95 blank holder
97 punch
97*a* punch bottom part
99 pad

The invention claimed is:

1. A method of forming a press-formed product including: a top portion; a side wall portion continuous with the top portion through top side ridge line portion; a flange portion continuous with the side wall portion; and a convex curve site curved in a convex shape and a concave curve site curved in a concave shape in a height direction along a longitudinal direction in side view, the method comprising:

forming an intermediate formed product from a blank by forming either one or both of convex and concave bead portions extending while being tilted relative to a baseline corresponding to the top side ridge line portion, at surface portions corresponding to sites of the side wall portion on both sides of the convex curve site in the longitudinal direction and at surface portions corresponding to sites of the side wall portion on both sides of the concave curve site in the longitudinal direction; and forming the press-formed product by squashing the bead portions in the intermediate formed product and extending a surface portion corresponding to the side wall portion in a bead orthogonal direction orthogonal to a long axis of the bead portion such that movement of material of the bead portions occurs to the surface portion corresponding to the side wall portion, the movement being directed to the forming direction, wherein the bead portions formed on both sides of the convex curve site are each tilted such that an end part of the bead portion, along the long axis, positioned on the convex curve site side is farther from the baseline and the other end part of the bead portion positioned on the opposite side is closer to the baseline; and the bead portions formed on both sides of the concave curve site are each tilted such that an end part of the bead portion, along the long axis, positioned on the concave curve site side is closer to the baseline and the other end part of the bead portion positioned on the opposite side is farther from the baseline.

2. The method according to claim 1, wherein the bead portions are formed such that an angle θ between the long axis of each bead portion and the baseline is 5° to 60°.

3. The method according to claim 2, wherein the angle θ between the long axis of each bead portion and the baseline satisfies a relation of $\theta \geq 90° - \theta_1$, where $\theta_1$ represents an acute angle between a forming direction of the press-formed product when forming the press-formed product and the top side ridge line portion.

* * * * *